US005564190A

United States Patent [19]

Fleetwood

[11] Patent Number: 5,564,190

[45] Date of Patent: Oct. 15, 1996

[54] COMBINED SHAVER AND SHAVING LUBRICANT DISPENSER

[76] Inventor: David P. Fleetwood, 5351 Raines Dr., Mobile, Ala. 36609

[21] Appl. No.: 567,273

[22] Filed: Dec. 5, 1995

[51] Int. Cl.[6] ..... B26B 21/44

[52] U.S. Cl. ..... 30/41; 30/535

[58] Field of Search ..... 30/41, 86, 90, 30/124, 125, 41.5, 85

[56] References Cited

U.S. PATENT DOCUMENTS

| | | | |
|---|---|---|---|
| 4,077,119 | 3/1978 | Sellera | 30/41 |
| 4,635,361 | 1/1987 | DeMars | 30/41 |
| 4,653,188 | 3/1987 | Kwak | 30/41 |
| 4,800,649 | 1/1989 | Cataudella | 30/41 |
| 4,868,982 | 9/1989 | McComas | 30/41 |
| 5,016,351 | 5/1991 | Drahus | 30/41 |
| 5,331,740 | 7/1994 | Carson, III et al. | 30/50 |
| 5,402,697 | 4/1995 | Brooks | 30/41 X |

*Primary Examiner*—Hwei-Siu Payer
*Attorney, Agent, or Firm*—Joseph N. Breaux

[57] ABSTRACT

A combined shaver and shaving lubricant dispenser including a pressurized lubricant cartridge having a quantity of shaving lubricant disposed therein under pressure and a dispensing valve including a dispensing nozzle extending from the cartridge of the type that allows the lubricant to escape from the cartridge when the dispensing nozzle is depressed; and a shaver/dispensing head including a shaving assembly including at least one razor type shaving blade and a lubricant dispersal nozzle including an attachment fitting that is attachable to the dispensing valve of the cartridge that is in fluid communication with a manifold chamber, the manifold chamber in-turn being in fluid communication with a plurality of dispersing apertures formed between the exterior of the dispensing head and the manifold chamber. The shaver/dispensing head includes a skirt portion extending around the attachment fitting in use that forms an overlapping cover between the shaver/dispensing head and an end of the pressurized lubricant cartridge including the dispensing nozzle.

4 Claims, 1 Drawing Sheet

COMBINED SHAVER AND SHAVING LUBRICANT DISPENSER

TECHNICAL FIELD

The present invention relates to devices utilized for removing unwanted body hair and more particularly to a combined shaver and shaving lubricant dispenser.

BACKGROUND ART

It is often desirable, when traveling or otherwise away from home or office, to shave before an important meeting or social occasion. However, it is inconvenient for most individuals to carry a separate shaver and shaving cream dispenser both before and after use. In addition, it is often impossible to anticipate that such items will be necessary when leaving the home or office. It would, therefore, be desirable to have a disposable type razor that included a supply of shaving lubricant that could be readily purchased when required. It would also be a benefit if the combined disposable razor and shaving lubricant dispenser were sized to allow the unit to be kept in a glove box of an auto or in a briefcase until required. It would be further benefit if the shaving lubricant was a conventional cream or foam type shaving lubricant.

GENERAL SUMMARY DISCUSSION OF INVENTION

It is thus an object of the invention to provide a combined shaver and shaving lubricant dispenser.

It is a further object of the invention to provide a combined shaver and shaving lubricant dispenser that is sized to allow the unit to be kept in a glove box of an auto or in a briefcase until required.

It is a still further object of the invention to provide a combined shaver and shaving lubricant dispenser that includes a supply of foam type shaving cream.

It is a still further object of the invention to provide a combined shaver and shaving lubricant dispenser that includes a shaver unit and dispensing nozzle that may be reused with a pressurized shaving lubricant cartridge.

It is a still further object of the invention to provide a combined shaver and shaving lubricant dispenser that accomplishes all or some of the above objects in combination.

Accordingly, a combined shaver and shaving lubricant dispenser is provided. The combined shaver/dispenser includes a pressurized lubricant cartridge, having a quantity of shaving lubricant disposed therein under pressure, and a dispensing valve including a dispensing nozzle extending from the cartridge of the type that allows the lubricant to escape from the cartridge when the dispensing nozzle is depressed; and a shaver/dispensing head including a shaving assembly including at least one razor type shaving blade and a lubricant dispersal nozzle including an attachment fitting that is attachable to the dispensing valve of the cartridge that is in fluid communication with a manifold chamber, the manifold chamber in-turn being in fluid communication with a plurality of dispersing apertures formed between the exterior of the shaver/dispensing head and the manifold chamber. The shaver/dispensing head preferably includes a skirt portion extending around the attachment fitting that forms an overlapping cover between the shaver/dispensing head and an end of the pressurized lubricant cartridge that includes the dispensing nozzle. The pressurized lubricant cartridge is preferably narrower at the end having the dispensing nozzle than the other end thereof. The exterior of the cartridge preferably includes a plurality of protruding structures to make gripping the cartridge easier in use.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
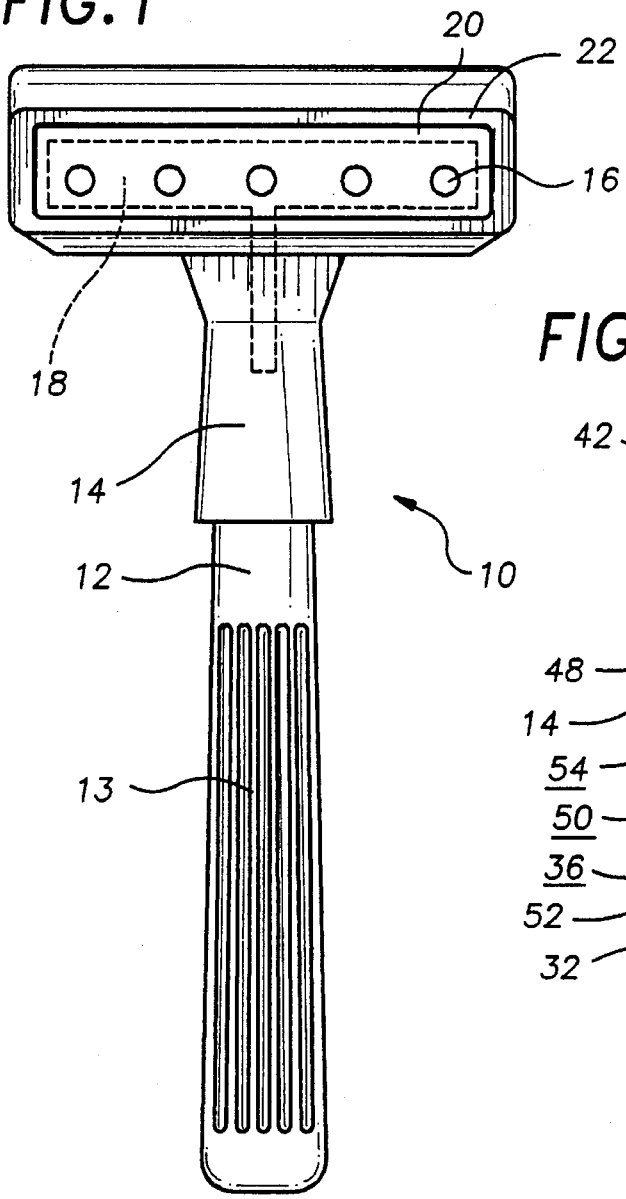
FIG. 1 is a side view of an exemplary embodiment of the combined shaver/dispenser of the present invention showing the lubricant cartridge and the shaver/dispensing head including five dispensing apertures.

FIG. 1 shows a side view of an exemplary embodiment of the combined shaver/dispenser of the present invention generally designated by the numeral 10. Shaver/dispenser 10 includes a pressurized lubricant cartridge 12 having five elongated gripper protrusions 13; and a shaver/dispensing head 14 that includes five dispensing apertures 16 that are formed through a planar dispensing surface 20 that is surrounded completely by a raised leveling ridge 22. Each of the five dispensing apertures 16 is in connection with a manifold chamber 18 (shown in the figure in dashed lines).

Figure 2:
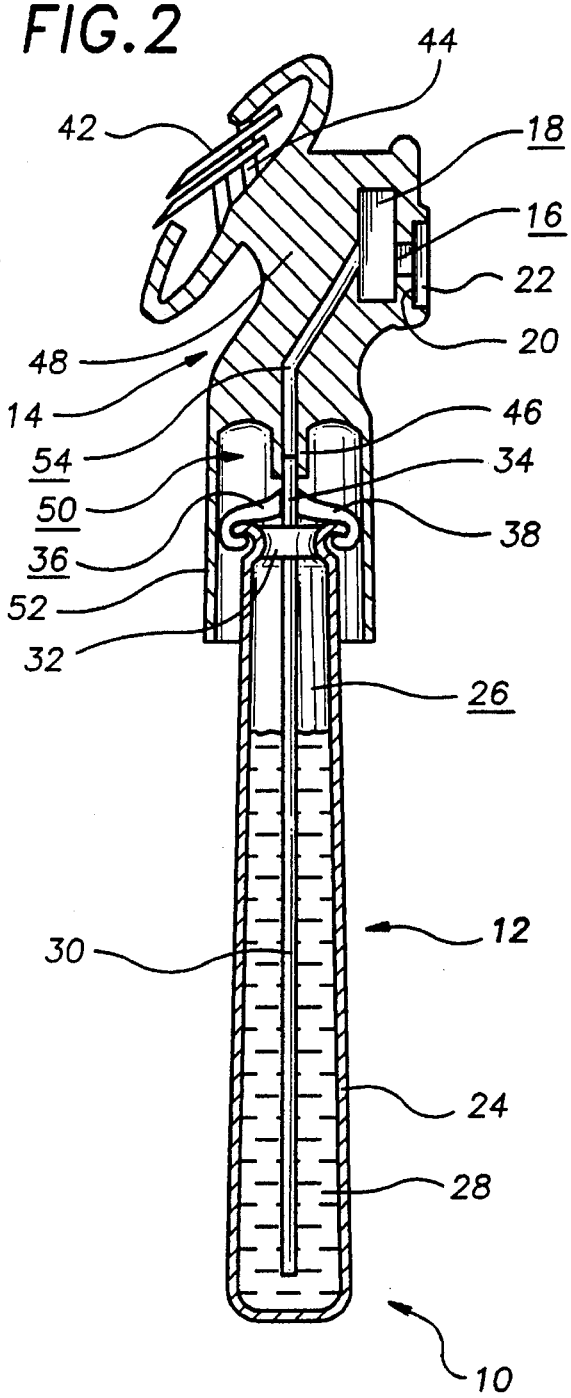
FIG. 2 is a cross-sectional view of the shaver/dispenser of FIG. 1 showing the lubricant channel, in connection between the dispensing valve and the manifold chamber; one of the dispensing apertures; and the skirt portion of the shaver/dispensing head surrounding the dispensing nozzle end of the pressurized lubricant cartridge.

FIG. 2 is a cross-sectional view of shaver/dispenser 10 showing shaver/dispensing head 14 and pressurized lubricant cartridge 12. Lubricant cartridge 12 includes a housing 24, having a lubricant chamber 26 that contains about a two shave supply of shaving lubricant 28. A draw tube 30 is in connection with a dispensing valve 32 and both are disposed within lubricant chamber 26. A dispensing nozzle 34 protrudes from dispensing valve 32 and extends through a nozzle aperture 36 of a cartridge cap member 38 that seals pressurized lubricant chamber 26. Lubricant 28 is forced out from lubricant chamber 26 through draw tube 30, dispensing valve 32, and dispensing nozzle 34 when dispensing nozzle 34 is depressed.

Shaver/dispensing head 14 includes a shaving assembly, generally designated by the numeral 40, that includes a pair of razor blades 42 that are held in a shaving position by a bracket 44. An attachment fitting 46 that frictionally fits over dispensing nozzle 34 extends from a main body section 48 and within a cartridge end receiving orifice 50. Receiving orifice 50 is partially defined by a skirt portion 52 and is sized to allow the end of lubricant cartridge 12 to move freely in and out thereof.

Attachment fitting 46 includes a lubricant channel 54 that leads to manifold chamber 18. As discussed hereinbefore, manifold chamber 18 is in connection with the five dispensing apertures 16. Also more clearly shown in the figure is the raised nature of raised leveling ridge 22 with respect to planar dispensing surface 20.

Use of shaver/dispenser 10 is now described with general reference to FIGS. 1 and 2. Because of its normal size, shaver dispenser 10 is stored in the same manner and places as a conventional disposable razor. As with all pressurized canisters, care should be taken not subject shaver/dispenser 10 to extreme temperatures. When it is desired to shave, shaver/dispenser 10 is shaken vigorously in the normal fashion of a can of shaving cream. Once shaver/dispenser 10 is shaken, planar dispensing surface 20 is placed adjacent the skin surface to be shaved while shaver/dispensing head 14 is simultaneously urged toward lubricant cartridge 12 until dispensing nozzle 34 is depressed sufficiently to release a quantity of shaving lubricant 28. Once released, shaving lubricant 28 travels through lubricant channel 54, into manifold chamber 18, out through the five dispensing apertures 16, and out onto the skin to be shaved. As the shaving lubricant is dispensed, leveling ridge 22 is used to smooth the shaving lubricant 28 onto the skin surface. Shaving is accomplished in the normal fashion. In this exemplary embodiment, lubricant cartridge 12 is supplied with enough lubricant for about two shaves.

It can be seen from the preceding description that a combined shaver and shaving lubricant dispenser has been provided that is sized to allow the unit to be kept in a glove box of an auto or in a briefcase until required; that includes a supply of foam type shaving cream; and that includes a shaver unit and dispensing nozzle that may be reused with a pressurized shaving lubricant cartridge.

It is noted that the embodiment of the combined shaver and shaving lubricant dispenser described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combined shaver and shaving lubricant dispenser comprising:

a pressurized lubricant cartridge having a quantity of shaving lubricant disposed therein under pressure and a dispensing valve including a dispensing nozzle, said dispensing valve being of the type that is open when said dispensing nozzle is depressed into said dispensing valve; and a shaver/dispensing head including:

at least one razor type shaving blade mounted thereon, an attachment fitting extending therefrom that is attachable to said dispensing nozzle of said dispensing valve, a manifold chamber formed therein in fluid communication with said attachment fitting, a plurality of dispensing apertures formed through a substantially planar dispensing surface, each of said dispensing apertures being in fluid communication with said manifold chamber, and a skirt portion that extends around said attachment fitting and forms an orifice to receive therein an end of said pressurized lubricant cartridge that includes said dispensing nozzle.

2. The combined shaver and shaving lubricant dispenser of claim 1, wherein:

said pressurized lubricant cartridge includes a plurality of elongated gripper protrusions on an exterior surface thereof.

3. The combined shaver and shaving lubricant dispenser of claim 1, wherein:

said planar dispensing surface is surrounded by a raised leveling ridge.

4. The combined shaver and shaving lubricant dispenser of claim 3 wherein:

said pressurized lubricant cartridge includes a plurality of elongated gripper protrusions on an exterior surface thereof.

* * * * *